US005607153A

United States Patent [19]

Bailey

[11] Patent Number: 5,607,153

[45] Date of Patent: Mar. 4, 1997

[54] DISTANCE MARKER WITHIN A GOLF COURSE FAIRWAY

[76] Inventor: John M. Bailey, 1249 Golfside Dr., Sebring, Fla. 33870

[21] Appl. No.: 573,484

[22] Filed: Dec. 15, 1995

[51] Int. Cl.[6] ..... A63B 57/00

[52] U.S. Cl. ..... 473/150; 116/209

[58] Field of Search ..... 273/32 R; 473/150, 473/405

[56] References Cited

U.S. PATENT DOCUMENTS

| | | | |
|---|---|---|---|
| 2,774,323 | 12/1956 | Kirk | 116/63 P |
| 3,067,717 | 12/1962 | Imparato | 116/173 |
| 3,362,305 | 1/1968 | Pellowski | 94/1.5 |
| 4,696,134 | 9/1987 | Neaume | 52/103 |
| 4,862,823 | 9/1989 | Hughes | 116/209 |
| 5,072,940 | 12/1991 | Bailey | 273/176 A |
| 5,114,149 | 5/1992 | Bailey | 273/176 A |
| 5,215,033 | 6/1993 | Gipp et al. | 116/209 |
| 5,247,900 | 9/1993 | Sobczak | 116/209 |
| 5,357,897 | 10/1994 | Bailey | 116/209 |
| 5,441,257 | 8/1995 | Sheaffer | 273/32 R |

*Primary Examiner*—William H. Grieb
*Attorney, Agent, or Firm*—Charles J. Prescott

[57] ABSTRACT

A visual distance marker for a golf course fairway which provides viewable indicia of distance along the fairway. The marker member has a generally uniform x- or cross-shaped cross section which facilitates being viewable from any direction on the fairway. The device includes an elongated resilient, preferably molded polyurethane marker member having its lower end slidably positioned and secured inside a tubular anchor member. When the anchor member is implanted or buried in the ground, the marker member is supported in an upright orientation extending above the ground, being supported within the tubular anchor member. The marker member is sufficiently resilient in all directions so as to be deflected and bent over against the ground as a reel-type lawn mower approaches and passes there over, thus eliminating the need for removing and replacing the entire device or just the marker member during normal mowing operations.

3 Claims, 1 Drawing Sheet

DISTANCE MARKER WITHIN A GOLF COURSE FAIRWAY

BACKGROUND OF THE INVENTION

1. Field of the Invention

This invention relates generally to viewable marking devices, and more particularly to an improved resilient viewable distance marker for use in golf courses along the length of a fairway.

2. Prior Art

Knowing the distance of a golf ball from a particular position on a fairway after being struck from a tee is quite important in the game of golf. This information not only provides the golfer with feedback as to the length of the initial drive from the tee, but also provides immediate information as to the distance from ball placement to the green of that particular fairway. When it is likely that, on the golfer's next shot, he will reach the green, this information becomes of even more importance.

One device known to applicant which serves this function is in the form of a concrete disc buried in the ground flush with the ground's surface so that mowing machines may pass there over without damage. Other objects used for this purpose are stakes or shrubbery planted on each side of the fairway in the rough away from normal mowing operations.

These above devices are unsatisfactory for their intended use. The concrete discs are difficult to see from any distance and typically result in delay of the game as a player searches for the marker. Likewise, shrubbery and stakes planted in the rough are often damaged or knocked down despite careful mower operator avoidance maneuvers.

Applicant is also aware of one prior art device disclosed in U.S. Pat. No. 3,067,717 to Imparato which teaches a portable resilient marker having a coiled spring member positioned just above the ground level as a lower extension thereof is embedded in the ground. However, this device would clearly become damaged or destroyed the first time that a fairway mower passes over it. Therefore, this device would require removal during normal mowing operations.

Applicant is also aware of the following references which were cited during that prosecution:

| | |
|---|---|
| Kirk | 2,774,323 |
| Pellowski | 3,362,305 |
| Neaume | 4,696,134 |
| Hughes | 4,862,823 |

However, none of these references perform a function or have structure which is similar to that of the present invention.

Confronted with this problem, and being aware that a reel-type mower in either single or gang form is used for fairway mowing, applicant's two previous inventions were intended to provide a device which clearly satisfies this need and takes advantage of the inherent structural features of these reel-type mowers. A visual distance marker was provided as disclosed in U.S. Pat. Nos. 5,072,940 and 5,114,149 which is implanted or buried within the ground on the fairway having an upwardly extending marker strip which is of sufficient width, when placed generally transversely to the length of the fairway, so as to be viewable by a golfer from a significant distance there from. Additionally, the marker strip, being resilient in one direction because of its thinness, will be resiliently deflected downwardly against the ground as the mower is passed there over and then returning to its generally upright position thereafter without damage or the need for removal. However, in use, I realized that the exposed marker strips of these prior patents could not be easily seen when viewed from the edge thereof.

Another of my previous patents, U.S. Pat. No. 5,357,897, represents a still further improvement over prior art, including my previous two referenced U.S. patents. This '897 patent discloses a resilient, tubular marker tube which extends downwardly into the tubular anchor member implanted in the ground and upwardly above the ground a distance sufficient for a golfer to view same from a useful distance. Through the utilization of preferred resilient elastomer or polyurethane marker tube in lieu of the flat plastic marker strips of my previous patents, that invention was intended to be virtually unaffected by mowing operations, regardless of the mowing direction of the fairway. Although overcoming poor marker visibility from certain directions, the '897 device has shown a tendency to experience occasional damage due to mowing operations.

The present invention provides yet further improvement over the prior art and my three previous U.S. patents by providing a marker member having an x- or cross-shaped cross section of preferably molded polyurethane to define four uniform radially extending fins or blades which not only provide clear visibility from all directions of view on the fairway, but also virtually eliminates all damage due to lawn mowing operations.

BRIEF SUMMARY OF THE INVENTION

This invention is directed to a visual distance marker for a golf course fairway which provides viewable indicia of distance along the fairway. The marker member has a generally uniform x-or cross-shaped cross section which facilitates being viewable from any direction on the fairway. The device includes an elongated resilient, preferably molded poly-urethane marker member having its lower end slidably positioned and secured inside a tubular anchor member. When the anchor member is implanted or buried in the ground, the marker member is supported in an upright orientation extending above the ground, being supported within the tubular anchor member. The marker member is sufficiently resilient in all directions so as to be deflected and bent over against the ground as a reel-type lawn mower approaches and passes there over, thus eliminating the need for removing and replacing the entire device or just the marker member during normal mowing operations.

It is therefore an object of this invention to provide a visual distance marker for golf course fairways which may be embedded or buried in the ground without the need for removal during normal mowing operations.

It is yet another object of this invention to provide a visible distance marker for golf course fairways which is easily viewable from a considerable distance and from any direction so that it may quickly located during normal golf play.

It is yet another object of the above invention to be economical to manufacture and easily deployable into the fairway at any desired location.

It is yet another object of this invention to provide an upright viewable marker member which bears distance indicia either from a golf tee and/or to the next associated green or hole.

It is still another object of this invention to provide a visible distance marker for golf course fairways which will resiliently deflect and return to an upright position regardless of the angle of fairway mowing.

In accordance with these and other objects which will become apparent hereinafter, the instant invention will now be described with reference to the accompanying drawings.

DETAILED DESCRIPTION OF THE INVENTION

Figure 2:
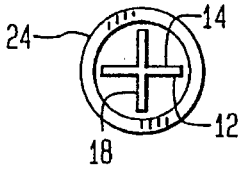
FIG. 2 is a top plan view of FIG. 1.
Figure 1:
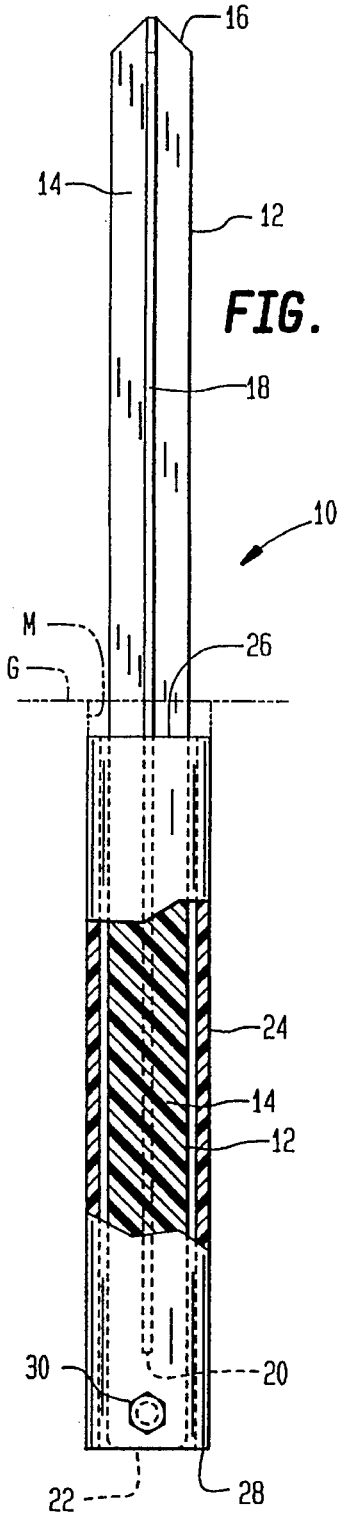
FIG. 1 is a front elevation broken section view of the preferred embodiment of the invention.
Figure 3:
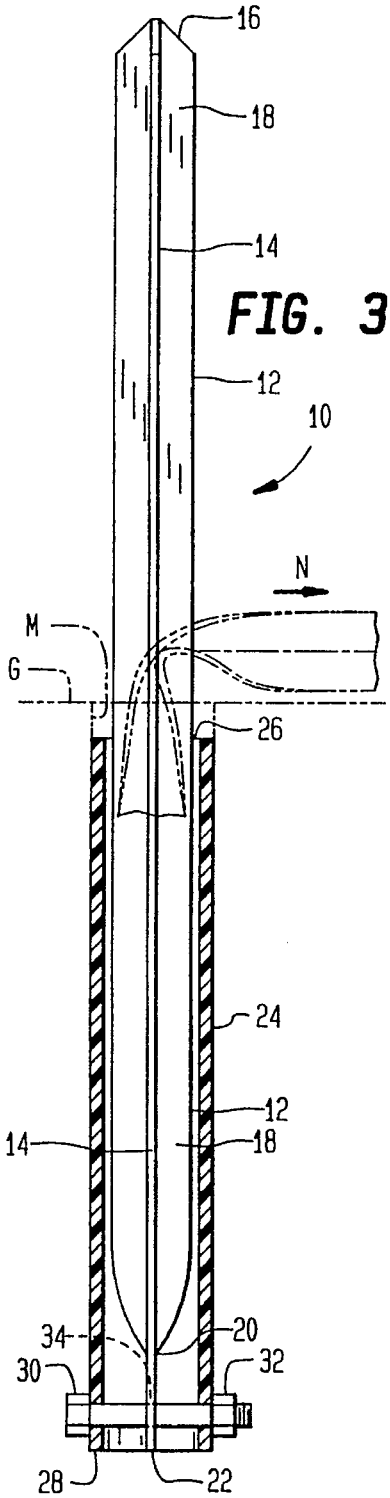
FIG. 3 is a side elevation partial section view of the invention in FIG. 1 also showing the deflected marker member in phantom.

Referring now to the drawings, and particularly to FIGS. 1 to 3, the preferred embodiment of the invention is shown generally at numeral 10 and includes an elongated, marker member 12 formed of molded polyurethane plastic and having a generally uniform cross or x-shaped cross section along substantially its entire length. The invention 10 also includes a rigid cylindrical anchor member 24 formed of plastic or p.v.c. cylindrical tubing. The upper end 16 of marker member 12 is pointed for distinctive appearance, while the upper exposed portion of marker member 12 may bear viewable indicia such as color corresponding to preselected distances from tee or green.

The marker member 12 is connected having its lower end 22 generally in alignment with a lower end 28 of the anchor member 24 by passing a bolt 30 through aligned holes in the side walls of the anchor member 24 and hole 34 adjacent the lower end 22 of the marker member 12. A nut 32 is threadably engaged onto bolt 30 as shown in FIG. 3 to retain this arrangement.

In this preferred embodiment 10, the opposing thin, uniform radially extending veins or blades 14 and 18 of the marker member 12 are slightly smaller in maximum transverse width than the inside diameter of the anchor member 24. The lower end 20 of opposing blades 18 terminates slightly above hole 34 for clearance. By these clearances between blades and anchor member and bolt and hole 34, the marker member 12 is free to rotate or twist about bolt 30 and with respect to itself within anchor member 24 so that when a lawn mower (not shown) passes there over in the direction of arrow N in FIG. 3, the marker member 12 is temporarily resiliently bent or kinked as shown in phantom to lay generally against ground G with a minimal amount of flexure, thereafter returning to upright, straight orientation.

It is recommended that the device 10 be installed into a fairway of a golf course by first drilling an upright hole M slightly deeper than the length of anchor member 24 so that the upper end 26 will be positioned slightly below the grade level G of the fairway at that point. When so installed, as the reel-type lawn mower passes over the device 10, the severity of the flexure of the marker member 12 shown in phantom in FIG. 3 is further minimized.

Figure 5:
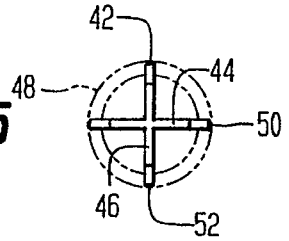
FIG. 5 is a top plan view of FIG. 4.
Figure 4:
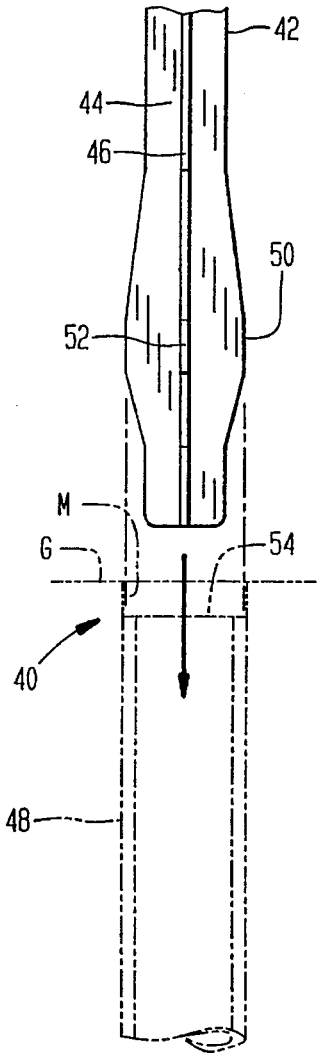
FIG. 4 is a front elevation view of a lower portion of another embodiment of the marker member with the anchor member shown in phantom.

Referring now to FIGS. 4 and 5, an alternate embodiment of the invention is there shown at numeral 40 and includes a cylindrical anchor member 48 sized and structured similar to the anchor member 24 previously described except that there is no bolt hole provided for connecting the marker member 42 thereto. With the anchor member 48 (in phantom) positioned having its upper end 54 embedded into a preformed hole M slightly below grade G as previously described, the marker member is simply forced downwardly in the direction of the arrow a distance sufficient to make contact with the bottom of hole M or as otherwise desired to dispose an upper portion of the marker member 42 above grade G for visibility.

To effect retention of the marker member 42 in an installed position within anchor member 48, each of the opposing blades or fins 44 and 46 are enlarged in width at 50 and 52 as shown so as to provide a transverse width at these enlargements 50 and 52 which is slightly larger in diameter than the inside diameter of anchor member 48. Otherwise, the blades or fins 42 and 44 are slightly smaller than the inside diameter of anchor member 48 as previously described.

By this arrangement, as the marker member 44 is forcibly urged into the anchor member 48, the enlarged blade portions 50 and 52 are flexed or deformed inwardly in arcuate fashion when viewed from above and it is this deformation which creates sufficient biasing pressure against the inside diameter of anchor member 48 for reasonable and useful retention therebetween.

Moreover, this embodiment 40 this also provides ease of removal of the marker member 42 for servicing and replacement. Of course, an alternate sequence of assembly envisions installing the marker member 42 within anchor member 48 by forcible urging from either end of anchor member 48 prior to installation of the entire assembly 40.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus, articles and materials.

What is claimed is:

1. A visual distance marker for a golf course which is implanted in an elongated fairway of the golf course and is materially unaffected by the operation of a reel-type lawn mower passing there over, said marker comprising:

a generally straight, resilient upstanding marker member having an upper portion and a lower portion and a generally uniform x- or cross-shaped cross section along substantially its entire length;

an elongated, straight, rigid tubular anchor member being completely embedded in upright orientation into a grassy area of the golf course fairway, said anchor member having a length generally in the range of that of said lower portion, said anchor member having an inside diameter slightly greater than a maximum width of said marker member;

said marker member slidably engagable into said anchor member whereby their lower ends are generally aligned one to another;

means for releasibly securing said marker member within said anchor member;

said marker member extending above ground a distance such that said marker member may be initially depressed by a leading edge bar of the lawn mower and said marker member will be subsequently depressed by the mower and rolling bar of the mower so that said marker member will not be severed when the grassy area of said fairway is being mowed in any direction across said fairway, said marker member being sufficiently resilient to return to its original straight and upstanding orientation thereafter;

said upper portion extending above the ground having indicia thereon for viewably communicating to a golfer positioned in any direction from said marker member the distance of said marker member from a tee or a green associated with said fairway.

2. A visual distance marker for a golf course which is implanted in an elongated fairway of a golf course and is materially unaffected by the operation of a reel-type lawn mower passing there over, said marker comprising:

a generally straight flexible upstanding marker member having an upper portion and a lower portion and a generally uniform cross-shaped cross section along substantially its entire length;

said marker member lower end connected to an elongated tubular anchor portion, said anchor portion being completely embedded into a grassy area of the golf course fairway;

said anchor portion having a length generally in the range of that of said upper portion, said marker member having a maximum width slightly less than an inside diameter of said tubular member;

said marker member and said tubular member connected adjacent their generally aligned lower ends by an elongated bolt or pin through aligned holes formed through said tubular member and said marker member;

said upper portion extending above ground a distance such that said marker member may be initially depressed by the leading edge bar of the lawn mower and said marker member will be subsequently depressed by the mower and rolling bar of the mower, so that said marker member will not be severed when the grassy area of said fairway is being mowed in any direction lengthwise or diagonally across said fairway said marker member being sufficiently resilient to return to its original straight and upstanding orientation thereafter;

indicia means on said upper portion for communicating to a golfer positioned in any direction from said marker member the distance of said marker member from a tee or a green associated with said fairway to enable a golfer to determine the distance a golf ball lying along the length of the fairway from the tee or the green.

3. A visual distance marker for a golf course which is implanted in an elongated fairway of the golf course and is materially unaffected by the operation of a reel-type lawn mower passing there over, said marker consisting essentially of:

a generally straight, resilient upstanding marker member having an upper portion and a lower portion and a generally x- or cross-shaped cross section along substantially its entire length;

an elongated, straight, rigid tubular anchor member being completely embedded in upright orientation into a grassy area of the golf course fairway, said anchor member having a length generally in the range of that of said lower portion;

means for releasibly securing said marker member within said anchor member;

said securing means being an enlarged portion in width of said marker member cross section along a segment of said lower portion, said enlarged portion having a width slightly larger than an inside diameter of said anchor member, the remainder of said marker member having a maximum width slightly smaller than the inside diameter of said anchor member whereby a remainder of said marker member above said enlarged portion will relatively freely twist in either direction with respect to said anchor member in response to each particular direction of contact with the lawn mower;

said marker member extending above ground a distance such that said marker member may be initially depressed by a leading edge bar of the lawn mower and said marker member will be subsequently depressed by the mower and rolling bar of the mower so that said marker member will not be severed when the grassy area of said fairway is being mowed in any direction across said fairway, said marker member being sufficiently resilient to return to its original straight and upstanding orientation thereafter;

said upper portion extending above the ground having indicia thereon for viewably communicating to a golfer positioned in any direction from said marker member the distance of said marker member from a tee or a green associated with said fairway.

* * * * *